US006438870B2

(12) United States Patent
Nasako et al.

(10) Patent No.: US 6,438,870 B2
(45) Date of Patent: Aug. 27, 2002

(54) SHOE SOLE WITH SHOCK ABSORBER STRUCTURE

(75) Inventors: Mitsuo Nasako; Tsuyoshi Nishiwaki; Shigeyuki Mitsui, all of Kobe (JP)

(73) Assignee: Asics Corporation, Kobe (JP)

( * ) Notice: Subject to any disclaimer, the term of this patent is extended or adjusted under 35 U.S.C. 154(b) by 0 days.

(21) Appl. No.: 09/850,495

(22) Filed: May 7, 2001

Related U.S. Application Data

(63) Continuation-in-part of application No. 09/431,285, filed on Oct. 29, 1999, now abandoned.

(30) Foreign Application Priority Data

Nov. 5, 1998 (JP) ..... 10-330220

(51) Int. Cl.[7] ..... A43B 13/18; A43B 23/28; A43B 13/00; A43B 5/00

(52) U.S. Cl. ..... 36/28; 36/103; 36/59 C; 36/114

(58) Field of Search ..... 36/28, 102, 103, 36/30 R, 31, 34 B, 59 A, 59 C, 71.5, 25 R, 114

(56) References Cited

U.S. PATENT DOCUMENTS

| | | | | | |
|---|---|---|---|---|---|
| 2,833,057 | A | * | 5/1958 | Hack | 36/59 C |
| 2,930,149 | A | * | 3/1960 | Hack et al. | 36/28 |
| 2,937,462 | A | * | 5/1960 | Hack et al. | 36/59 C |
| 2,941,316 | A | * | 6/1960 | Hack | 36/59 C |
| 3,947,979 | A | * | 4/1976 | Sidles | 36/32 R |
| 4,060,917 | A | * | 12/1977 | Canale | 36/59 C |
| 4,120,102 | A | * | 10/1978 | Kenigson | 36/71 |
| 4,774,774 | A | * | 10/1988 | Allen, Jr. | 36/28 |
| 5,138,776 | A | | 8/1992 | Levin | |
| 5,297,349 | A | | 3/1994 | Kilgore | |
| 5,367,791 | A | | 11/1994 | Gross et al. | |
| 5,369,896 | A | | 12/1994 | Frachey et al. | |
| 5,701,687 | A | | 12/1997 | Schmidt et al. | |
| 5,713,140 | A | * | 2/1998 | Baggenstoss | 36/28 |
| 5,718,063 | A | | 2/1998 | Yamashita et al. | |
| 5,729,916 | A | * | 3/1998 | Vorobiev et al. | 36/28 |
| 5,782,014 | A | | 7/1998 | Peterson | |
| 5,799,417 | A | * | 9/1998 | Burke et al. | 36/28 |
| 5,901,467 | A | | 5/1999 | Peterson et al. | |
| 5,926,974 | A | * | 7/1999 | Friton | 36/28 |
| 6,018,889 | A | * | 2/2000 | Friton | 36/28 |

* cited by examiner

*Primary Examiner*—Anthony D. Stashick
(74) *Attorney, Agent, or Firm*—Michael E. Zall

(57) ABSTRACT

A shock absorbing section (10) of a shoe sole (1) is provided with a shearing transformation element (11). This shearing transformation element (11, 11A) is supported at an upper position dislocated forward (F) with respect to a grounding surface (20) so that it performs a shearing transformation independently due to a load (W) applied from above.

22 Claims, 15 Drawing Sheets

SHOE SOLE WITH SHOCK ABSORBER STRUCTURE

CROSS REFERENCES TO RELATED APPLICATIONS

This application is a continuation in part of the U.S. patent application naming the same inventors that was assigned Ser. No. 09/431,285 and a filing date of Oct. 29, 1999, now abandoned. Foreign Priority for the parent application was claimed for Japanese Application 10-330220 filed Nov. 05, 1998. The entire disclosures of each of these applications is incorporated herein by reference.

BACKGROUND OF THE INVENTION

1. Field of the Invention

The present invention relates to a shoe sole and, more particularly, to a shock absorber structure for a shoe sole.

2. Description of the Related Art

Shoe soles are required to have shock absorbing performance.

In prior art shoe soles, generally, the grounding shock while walking is absorbed by the loss of energy by compression transformation of a shock absorbing section, such as the midsole. However, the absorption (or loss) of energy by only compression transformation is generally so low that sufficient shock absorption is not achieved, If the midsole is thickened to raise the energy loss, on the other hand, the shoe sole loses its light weight.

Hack U.S. Pat. No. 2,833,057 and Hack et al U.S. Pat. No. 2,930,149 disclose an outer sole provided with corrugations, undulations and projections each having a ground engaging triangular section. However, in this prior art, because these elements are triangular in section, they generate a large bending transformation, while scarcely performing any shearing transformation.

FIG. 15 herein is a perspective view of the shoe sole disclosed in Yamashita et al U.S. Pat. No. 5,718,063. This prior art discloses a midsole 500 provided with an element 501. However, because the element 501 is integrally formed with the side face of the midsole 500, the midsole 500 performs only a compression transformation as the midsole 500 is compressed. This is because the element 501 is not an element that transforms independently from the compression transformation element.

In Hack, Hack et al., and Yamashita et al., the elements discussed herein are identically formed on both the medial and the lateral sides of the foot. Hence, these elements can not assist in suppressing pronation.

SUMMARY OF THE INVENTION

It is, therefore, an object of this invention to improve the shock absorption by redesigning the structure of the shoe sole.

In order to achieve the above-specified object, according to a first aspect of the invention, a shoe sole is provided with a shock absorbing section with a shearing transformation element. This shearing transformation element is supported by a support member at an upper position dislocated forward with respect to a grounding surface so that when a load is applied from above it performs a shearing transformation independently in such a manner as to fall forward.

A second aspect of this invention is directed to a shoe sole having a midsole interposed between an upper suited for enveloping an instep and an outer sole having a treading face on its outer surface. The midsole includes a shearing transformation element. This shearing transformation element has a front end face and a rear end face. The front end face and the rear end face of the shearing transformation element are individually inclined forward as they go upward. With these inclinations of the two end faces, the shearing transformation element performs the shearing transformation in such a manner as to fall forward when a load is applied by the user's foot at grounding time during walking or running.

When the load W from above is applied by the user's foot at the grounding time during walking or running, according to this invention, the shearing transformation element falls forward. In effect, the load W creates not only a compression transformation but also a shearing transformation. Generally, the absorption of energy by the shearing transformation is far higher than that by the compression transformation so that even a small shearing transformation can absorb a high amount of energy. This enables a compact structure to exhibit high shock absorption.

There have been proposed in the prior art a number of midsoles having shock absorbing elements formed of extremely thin columns, which perform transformations by falling forward and backward. However, these extremely thin columns perform bending transformations not the shearing transformations of this invention.

In order to perform sufficient shearing transformation, the shearing transformation element is required to have a planar section of a predetermined size. In other words, the shearing transformation element has to be able to perform the required shearing transformation without any substantial bending transformation. For example, in a preferred embodiment, the shearing transformation element has a planar sectional area of preferably 4 $cm^2$ or more and most preferably 6 $cm^2$ or more. Thus, the scope of this invention does not include the prior art thin rod-shaped or plate-shaped elements which are formed into a truss or honeycomb shape.

In the preferred embodiments of the present invention, axes formed of loci of centers of plane sections of said shearing transformation elements are inclined forward as they go upward, respectively. Thereto between the plurality of shearing transformation elements, there are provided soft shock absorbing elements which have a smaller Young's modulus than that of the shearing transformation elements so that the individual shearing transformation elements can perform shearing transformations without any restriction from each other.

In another preferred embodiment of the present invention, at least the front end face or the rear end face of the shearing transformation element is provided in proximity or contiguity with a soft shock absorbing element. The soft shock absorbing element is set to have a smaller Young's modulus than that of the shearing transformation element so as to allow the shearing transformation of the shearing transformation element.

Because the shearing transformation element is provided in proximity with the soft shock absorbing element, the shearing transformation element transforms easily to sufficiently perform the shearing transformation function.

A third aspect of this invention is directed to a shoe sole having a midsole interposed between an upper suited for enveloping an instep and an outer sole having a treading face on its outer surface. The midsole comprises: a compression transformation element performing a compression transformation due to a load applied from above; a shearing transformation element performing a shearing transformation in such a manner as to fall forward due to the load applied from above; and a soft shock absorbing element. The shearing transformation element has a hollow portion adapted to enclose the soft shock absorbing element. The soft shock absorbing element is loaded into the hollow portion. The soft shock absorbing element is set to have a smaller Young's modulus than that of the shearing transformation element so as to allow the shearing transformation of the shearing transformation element.

In this aspect, because the shearing transformation element has the hollow portion, the shearing transformation element can transform easily. Furthermore, because the soft shock absorbing element is loaded into the hollow portion, it does not hold back the transformation of the shearing transformation element, and that is why the shearing transformation element can sufficiently perform the shearing transformation function.

A fourth aspect of this invention is directed to a shoe sole having a midsole interposed between an upper suited for enveloping an instep and an outer sole having a treading face on its outer surface. The midsole comprises: a compression transformation element performing a compression transformation due to a load applied from above; and a shearing transformation element disconnected from the compression transformation element. The shearing transformation element has a front end face and a rear end face. The front end face and the rear end face of the shearing transformation element are individually inclined forward as they go upward. Thereby with these inclinations of the two end faces, the shearing transformation element has a longitudinal section, as taken in the longitudinal direction, formed into a generally parallelogram shape, and the shearing transformation element performs a shearing transformation due to a load at a grounding time of a walking or running user's foot.

The shearing transformation element of the present aspect transforms independently from the compression transformation element, and has scarcely the continuity of transformation with respect to the compression transformation element. Consequently, satisfactory shearing transformation is exhibited. In addition, the shearing transformation element has a longitudinal section, as taken in the longitudinal direction, formed into a generally parallelogram shape. Consequently, it exhibits satisfactory shearing transformation without performing any bending transformation.

A fifth aspect of this invention is directed to a shoe sole having a midsole interposed between an upper suited for enveloping an instep and an outer sole having a treading face on its outer surface. The midsole comprises: a compression transformation element performing a compression transformation due to a load applied from above; and a shearing transformation element having minimal continuity of transformation relationship to the compression transformation element. The shearing transformation element has a front end face and a rear end face. The front end face and the rear end face of said shearing transformation element are individually inclined forward as they go upward. Thereby with these inclinations of the two end faces, the shearing transformation element performs a shearing transformation due to a load at a grounding time of a walking or running user's foot, the compression transformation element performs the compression transformation to absorb shock. The shearing transformation element is essentially disposed at a lateral side of a rear foot part in the midsole and is scarcely disposed or not disposed at all at a front foot part and a medial side of the rear foot part in the midsole.

In this aspect the shearing transformation element is disposed at the lateral side of the rear foot part in the midsole. However, the shearing transformation element is not disposed at the medial side of the foot in the midsole. Consequently, at the time of landing on the ground, the lateral side portion of the foot in the midsole performs shearing transformation as well as compression transformation, and absorbs the shock applied to the lateral side of the foot at the time of grounding. On the other hand, since no shearing transformation element is provided on the medial side of the foot, the medial side portion of the foot performs the compression transformation only and does not perform shearing transformation, and that is why it does not greatly transform. As a result, the pronation of the inclining foot toward the medial side is able to be suppressed. That is, in the present invention, even if the lateral side portion of the midsole greatly transforms at the time of grounding, the medial side portion is not easily transformed. Consequently, the pronation is able to be successfully suppressed.

A sixth aspect of this invention is directed to a shoe sole having a midsole interposed between an upper suited for enveloping an instep and an outer sole having a treading face on its outer surface. The midsole has a shearing transformation element, the shearing transformation element performs a shearing transformation due to a load at a grounding time of a walking or running user's foot.

Either an upper end face or a lower end face of the shearing transformation element is provided in proximity with a soft shock absorbing element which is set to have a smaller Young's modulus than that of the shearing transformation element.

In this aspect. because the shearing transformation is performed by not only the shearing transformation element but also the soft shock absorbing element, the shearing transformation element can easily perform the shearing transformation. Therefore, shock absorption is improved.

BRIEF DESCRIPTION OF THE DRAWINGS

This invention will be more clearly understood from the following description of its preferred embodiments, as made with reference to the accompanying drawings. However, these embodiments and drawings are presented merely for illustration and explanation and should not be employed to define the scope of the invention. The scope of this invention is defined on the basis of the appended claims. In the accompanying drawings, common reference numerals designate identical or corresponding portions or elements.

FIG. 1(*a*) is a plan view of a midsole wherein outer sole is not, affixed. FIG. 1(*b*) is a side elevation of this shoe sole with the outer sole affixed thereto.

FIGS. 6(*b*) and 6(*c*) are sectional views showing other embodiments of the invention.

FIG. 7(*a*) is a plan view of a midsole wherein outer sole is not affixed. FIG. 7(*b*) is a side elevation of this shoe sole with the outer sole affixed thereto.

DESCRIPTION OF THE PREFERRED EMBODIMENTS

Figure 1A:
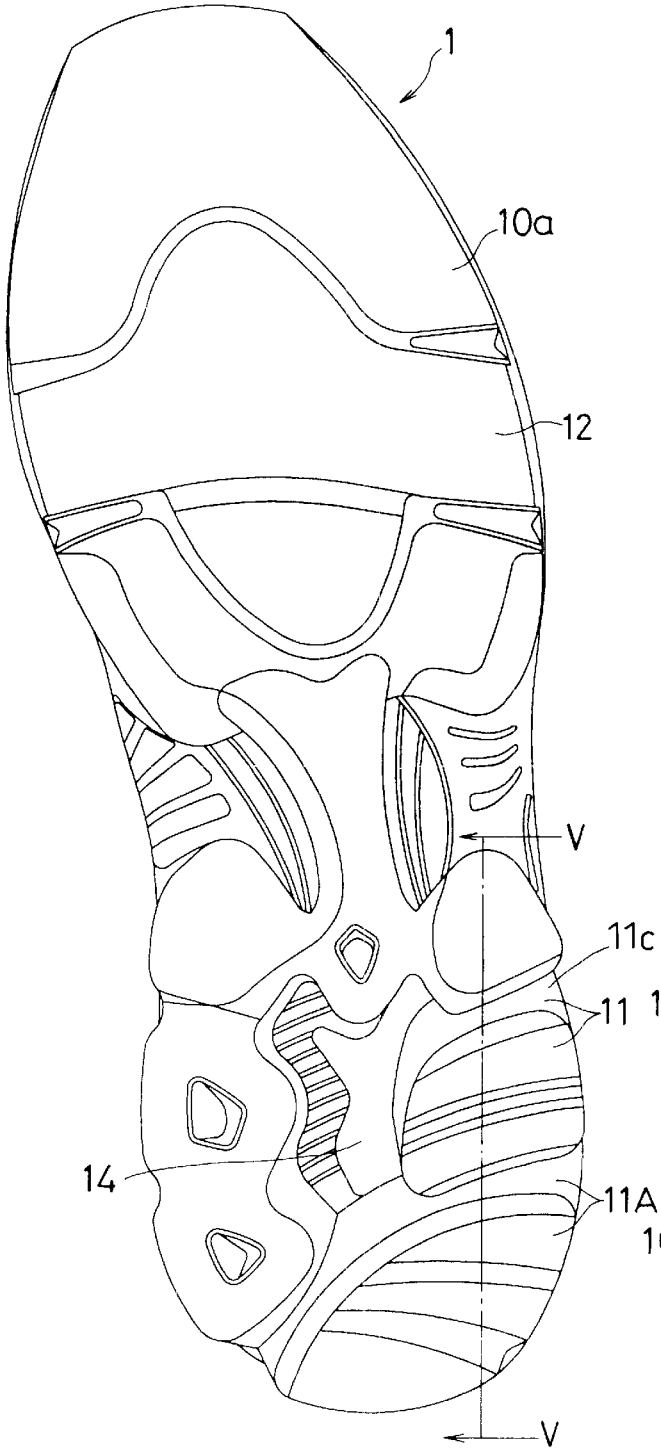
FIGS. 1(*a*) and 1(*b*) show a first specific embodiment of the invention, respectively.

The invention will be described in connection with its embodiments with reference to the accompanying drawings.

Principle Embodiment

Here will be described the fundamental structure and principle of the invention in connection with the embodiment shown in FIG. 6(*a*).

A shoe sole 1 is provided with a shock absorbing section 10. This shock absorbing section 10 has a first shearing transformation element 11 and a compression transformation element 12. The shearing transformation element 11 is supported by a support member 3 at an upper position dislocated forward F with respect to a grounding surface 20 of the sole 1. The shearing transformation element 11 thus performs a shearing transformation independently by falling forward (F direction) due to a load W being applied from above. The first shearing transformation element 11 has a front end face 11*c* and a rear end face 11*d*. In this first shearing transformation element 11, the front end face 11*c* and the rear end face 11*d* are individually inclined forward F as they go upward. In effect, the first shearing transformation element 11 has a longitudinal cross section that is generally a parallelogram in shape. When a load W which is applied at the grounding time by the user's foot in walking or running, with the two end faces 11*c* and 11*d* being thus inclined the first shearing transformation element 11 performs not only a compression transformation but also a shearing transformation by falling forward F, as indicated by double-dotted (phantom) lines in FIG. 6(*a*).

Figure 6A:
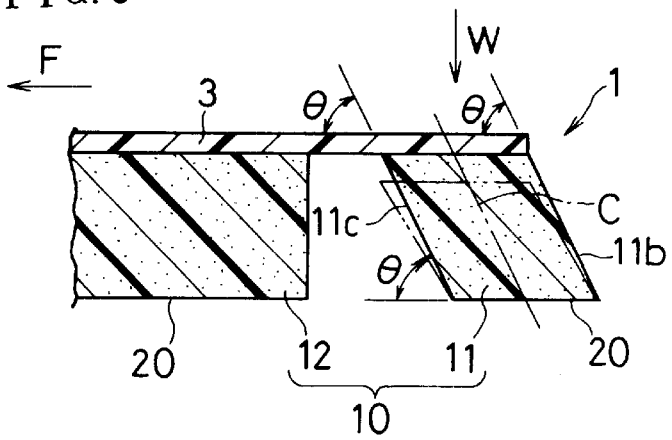
FIG. 6(*a*) is a sectional view showing the principle of the invention.
Figure 6B:
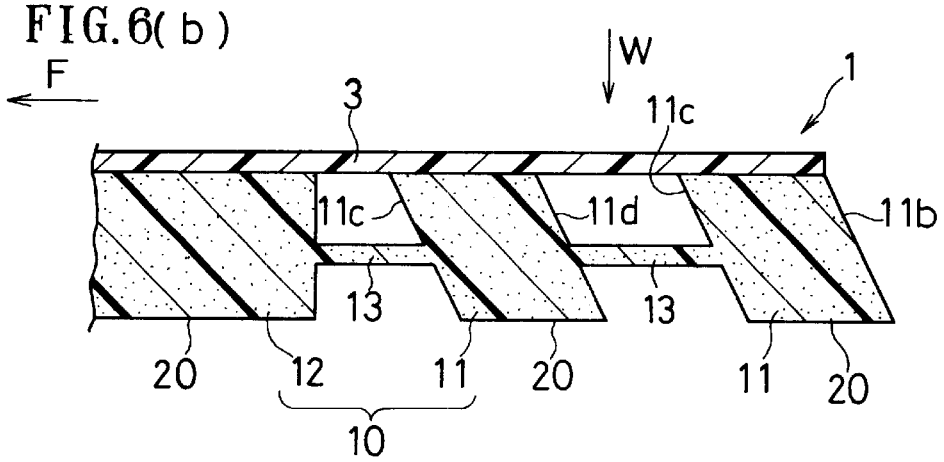
Figure 6C:
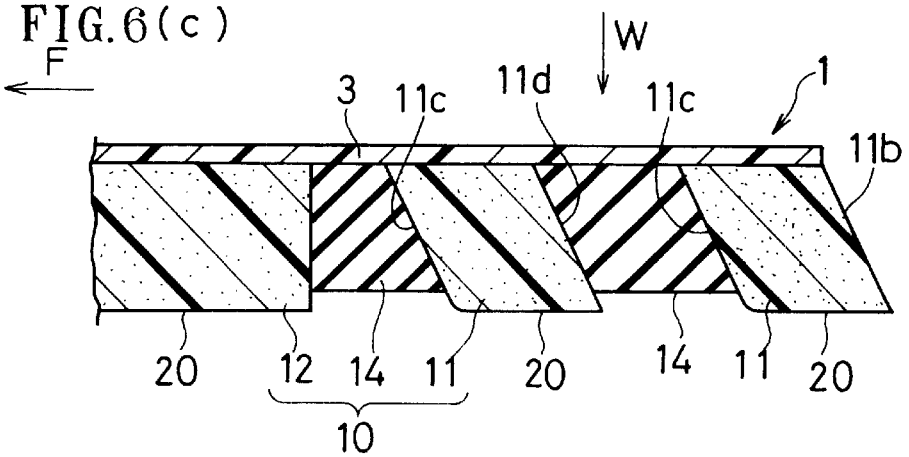

Still referring to FIG. 6(*a*), preferably the two end faces 11*c* and 11*d* have an angle θ of inclination of about 30 to 60 degrees. Most preferably, this angle of inclination is about 40 to 50 degrees.

As used herein, the "shock absorbing section" means a portion of the shoe sole, excluding the outer sole (or a grounding sole) and the insole that receives the load from the foot, and is generally composed of the midsole. On the other hand, the support member 3 is generally formed of the insole and a cup insole (or a cup-shaped insole).

The term "shearing transformation" means a transformation in which the sectional shape after the transformation resembles that before the transformation and when a load W is applied the inclination angle θ decreases. In other words, "to perform the shearing transformation" in the invention means that the fall of the shearing transformation element 11 in the forward direction F increases to effect the shearing transformation when the vertical load W is applied. On the other hand, the term "independently" means that the continuity of shearing transformation is not associated with or has very little relationship to the compression transformation element 12 other than the shearing transformation element 11 is included in the shock absorbing section 10, or that the shearing transformation element 11 performs far more shearing transformation than that of the compression transformation element 12.

In this invention, the first shearing transformation element 11 may be molded independently from the compression transformation element 12 of the shock absorbing section 10 as shown in FIG. 6(*a*). Optionally, as shown in FIG. 6(*b*), the first shearing transformation element 11 may be molded integrally with the compression transformation element 12 through a thin connecting portion 13.

Referring to FIG. 6(*a*), there may only be one first shearing transformation element 11, or as shown in FIG. 6(*b*) and 6(*c*) there may be two or more such elements. When two or more first shearing transformation elements 11 are provided, other soft shock absorbing elements 14 may be sandwiched therebetween.

Specific First Embodiment

A specific first embodiment of the invention will be described with reference to FIGS. 1 through 5.

Figure 1B:
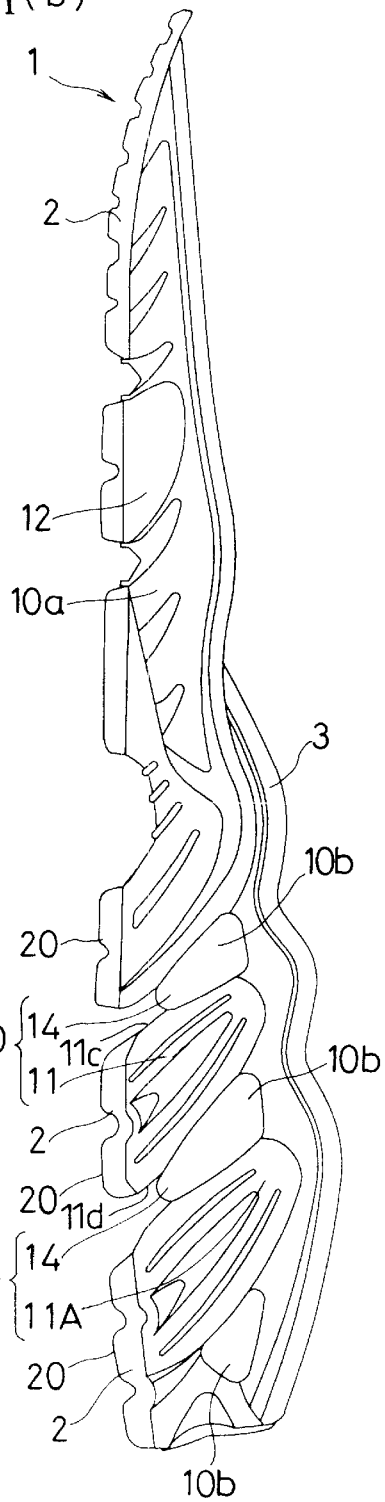
Figure 2:
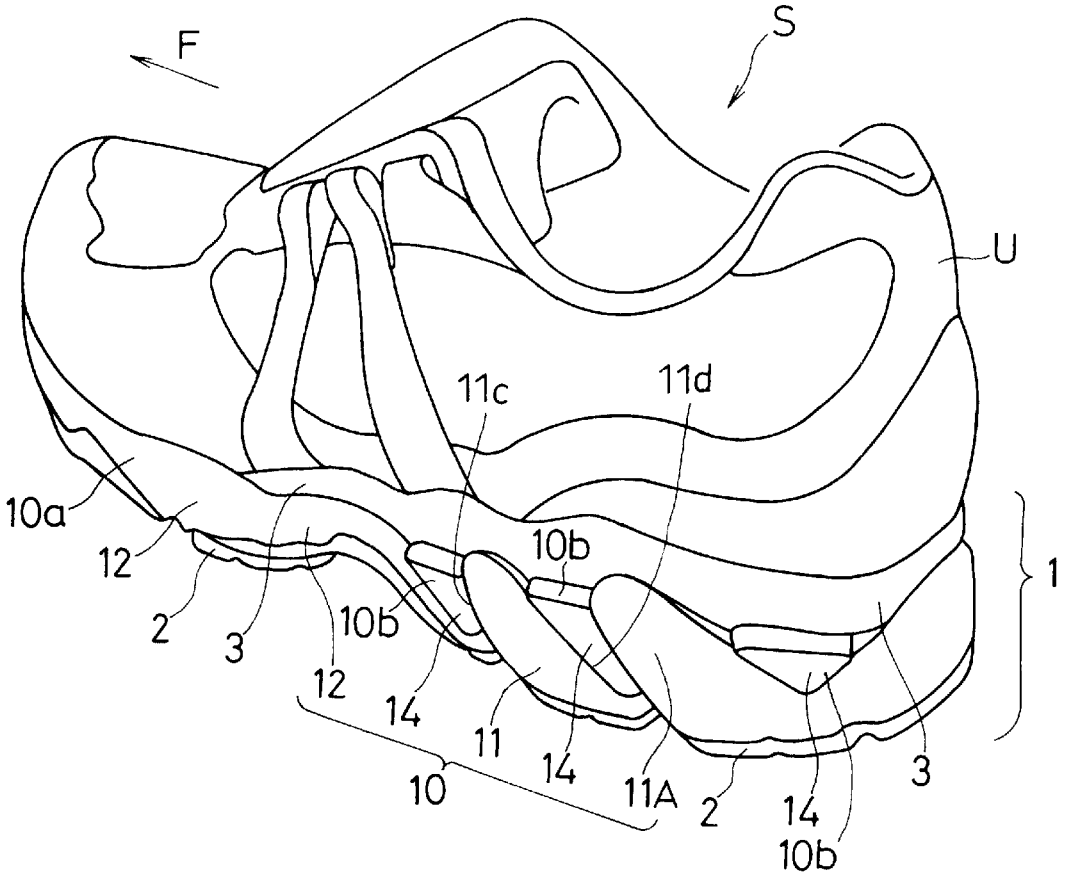
FIG. 2 it a perspective view of a shoe having the sole and midsole of FIGS. 1(*a*) and 1(*b*) taken obliquely from the back of the shoe.

As shown in FIG. 2, a shoe S is provided with the sole 1 and an upper U disposed over the sole 1. This upper U is given a suitable shape/structure as to accommodate and enclose the foot of a user. As shown in FIG. 1(*b*), the sole 1 is formed by joining the outer sole (or the grounding sole) 2, the midsole (or the shock absorbing section) 10 and the cup-shaped insole (or the support member) 3 integrally with each other. Of these, the outer sole 2 has the treading surface (or the grounding surface) 20 on its outer surface. The insole 3 of FIG. 2 is joined to the upper U and receives the load W from the foot and is provided with a turned up section 30 at its rear end portion and at the two side portions (See FIG. 3).

Figure 3:
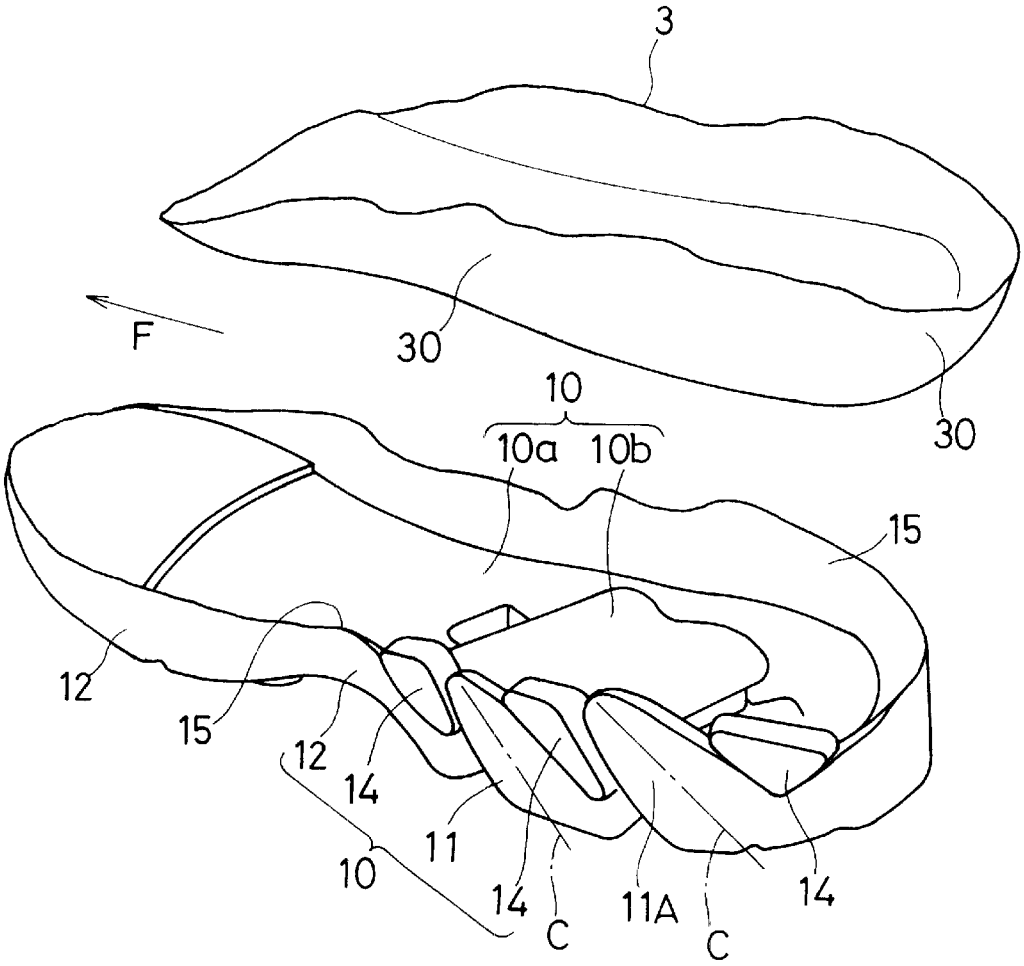
FIG. 3 is an exploded perspective view of the shoe shown in the aforedescribed Figures wherein the shock absorbing section and the support member disassembled.

The midsole 10 is interposed between the insole 3 and the outer sole 2 and is composed of a foam 10*a*, preferably a resin such as EVA, and a soft shock absorbing member 10*b*. Referring to FIG. 3, the upper face and inner side face 15 of foam 10*a* are fixed to the bottom face or turned up section 30 of the insole 3 by an adhesive. Referring to FIGS. 1(*a*) and 1(*b*), the outer sole 2 is fixed to the lower face of the foam 10*a*. As shown in FIG. 3, this foam 10*a* is provided with the first shearing transformation element 11, the second shearing transformation element 11A, and the compression transformation element 12, which consists of the portions other than the two shearing transformation elements 11 and 11A. The compression transformation element 12 performs compression transformation as in the ordinary shoe by absorbing shock.

Figure 5:
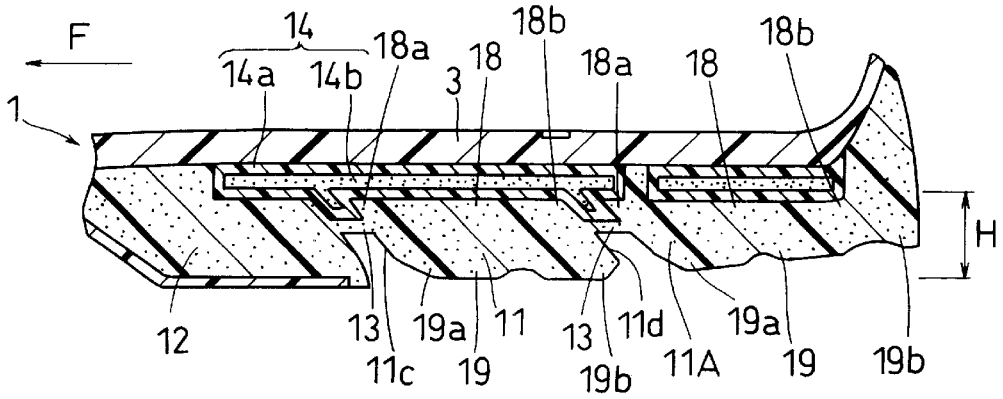
FIG. 5 is a sectional view taken along line V—V of FIG. 1(*a*).

As shown in FIG. 3, the two shearing transformation elements 11 and 11A are inclined forward and their axis C is slanted upward. As shown in FIG. 5, more specifically, each of the shearing transformation elements 11 and 11A is provided with an upper fixing section 18 and a lower fixing section 19. Of these, the upper fixing section 18 has front and rear end portions 18*a* and 18*b* and is fixed at its upper portion via the soft shock absorbing member 10*b* to the insole 3. The lower fixing section 19 has front and rear end portions 19*a* and 19*b* and is fixed at its lower portion to the outer sole 2. The front end portion 18*a* of the upper fixing section 18 is dislocated forward F with respect to the front end portion 19*a* of the lower fixing section 19. The rear end portion 18*b* of the upper fixing section 18 is dislocated forward F with respect to the rear end portion 19*b* of the lower fixing section 19. With these two fixing sections 18 and 19 being positioned, the individual shearing transformation elements 11 and 11A perform the shearing transformation by falling forward F without any substantial bending transformation due to the load W applied by the user's foot at the grounding time during walking or running. As a result, the shocks from running or walking are absorbed. Furthermore, the "axis C" of FIG. 3 is a locus of the centers of the planar sections (or sections parallel to the horizontal plane) of the shearing transformation sections 11 and 11A.

Figure 4:
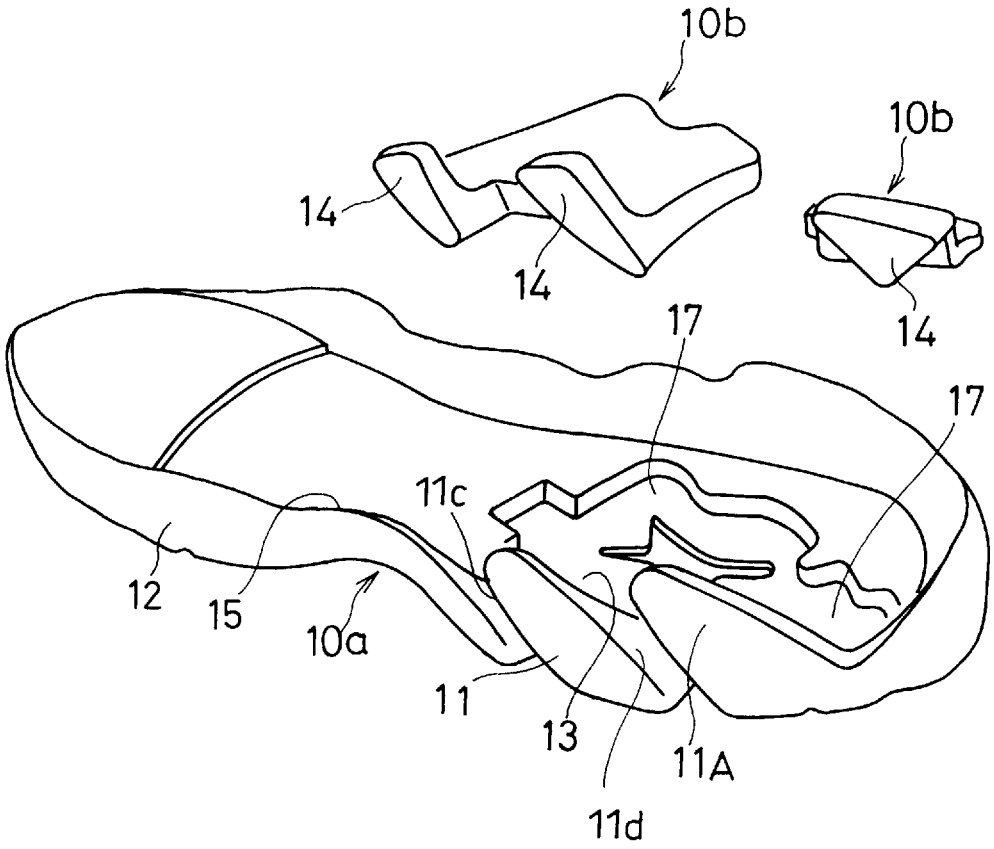
FIG. 4 is an exploded perspective view of the shoe shown in the aforedescribed Figures wherein the foam and the soft shock absorbing member of the shock absorbing section are disassembled.

Referring to FIGS. 4 and 5, in this embodiment, the first shearing transformation element 11 is formed integrally with the compression transformation element 12 and the adjoining second shearing transformation element 11A through only the thin connecting portion. 13. In order to perform a sufficient shearing transformation, the first shearing transformation element 11 is set to have a height H of preferably 8 mm or more or most preferably 10 mm or more.

As shown in FIG. 3, preferably each of the shearing transformation elements 11 and 11A is disposed outside of the rear foot part in the midsole 10. This is because the shocks at the grounding time are absorbed, since the foot is generally grounded at the running or walking time from the outer side portion of the rear foot part.

Between those shearing transformation elements 11 and 11A, there are sandwiched the other soft shock absorbing elements 14 which have a smaller Young's modulus than that of the shearing transformation elements 11 and 11A. These soft shock absorbing elements 14 allow the individual shearing transformation elements 11 and 11A to perform their shearing transformations with minimal any restriction from each other.

As shown in FIG. 5, the soft shock absorbing elements 14 are made by filling sealed containers 14*a* made of a resin, for example, with the so-called "gel 14*b*". These soft shock absorbing elements 14 absorb the shocks from the overlying support member 3 and, as shown in FIG. 4, are arranged in recesses 17 of the foam 10*a* and in front and at the back of the shearing transformation element 11.

In the foregoing embodiment, the individual shearing transformation elements 11 and 11A are molded integrally with the foam 10*a* but may also be separately molded. However, the integral molding is preferred because separate moldings require a larger number of parts.

Figure 7A:
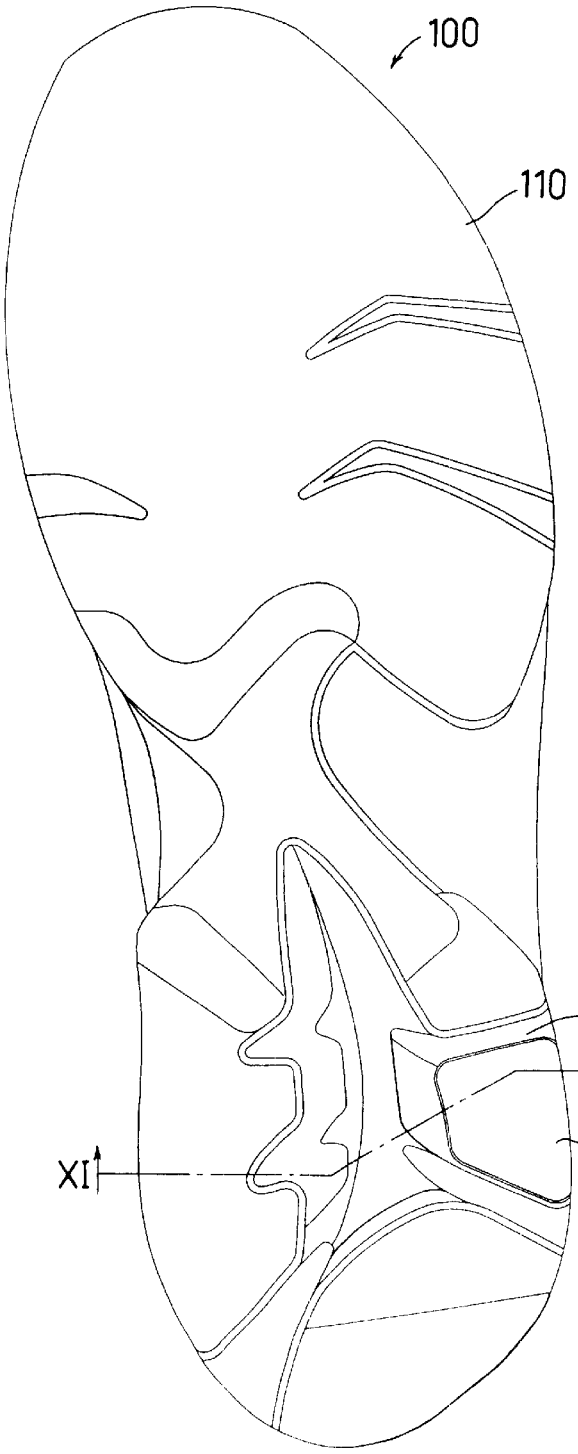
FIGS. 7(*a*) and (7*b*) show a second specific embodiment of the invention.
Figure 7B:
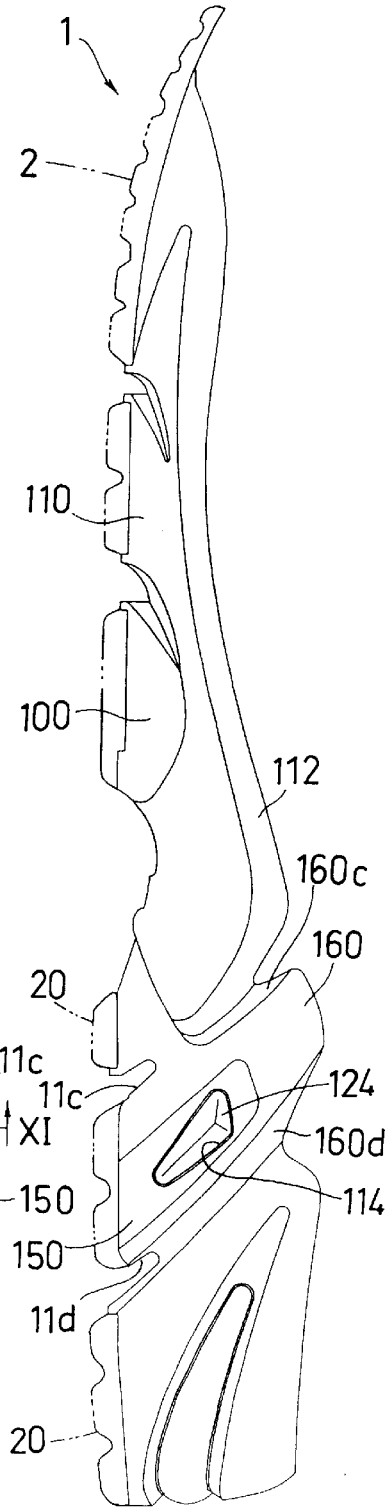

The following is a description of the preferred embodiments shown in FIGS. 7(*a*) through 14(*b*).

Specific Second Embodiment

A specific second embodiment of the invention will be described with reference to FIGS. 7(*a*) through 11.

Figure 8:
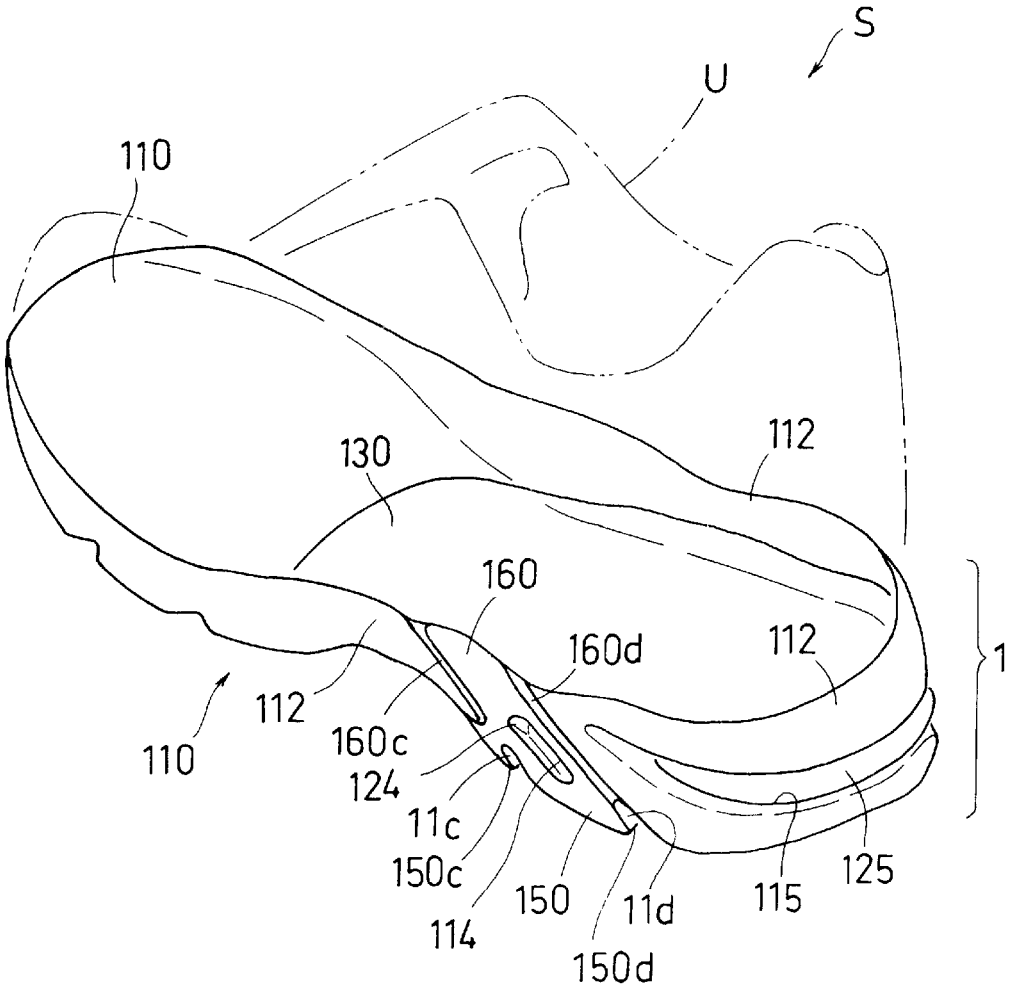
FIG. 8 is a perspective view of the shoe having the sole and midsole of FIGS. 7(*a*) and 7(*b*) taken obliquely from the back of the shoe.

As shown in FIG. 8, a shoe S is provided with the sole 1 and an upper U disposed over the sole 1. This upper U is given a suitable shape/structure as to accommodate and enclose the foot of a user. As shown in FIG. 7(*b*), the sole 1 is formed by joining the outer sole (or the grounding sole) 2 and the midsole 100 integrally with each other. Of these, the outer sole 2 has the treading surface (or the grounding surface) 20 on its outer surface.

Figure 10:
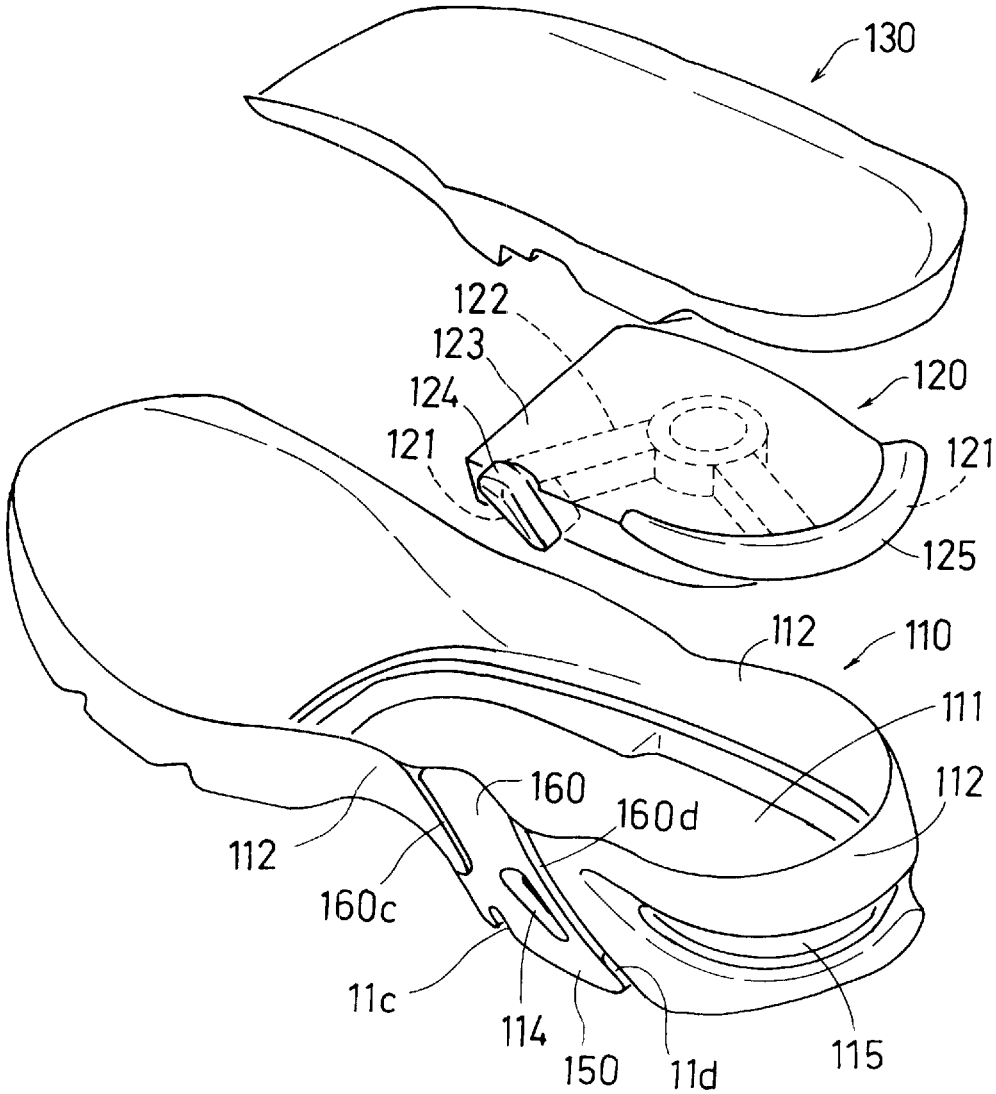
FIG. 10 is an exploded perspective view of the midsole shown in the aforedescribed Figures wherein the midsole is further disassembled.

As shown in FIG. 10, the midsole 100 comprises a midsole body 110, a mount part 120 and a cap 130. The midsole body 110 and the cap 130 are composed of a resin such as EVA(ethylene-vinyl acetate copolymer).

A rear foot part of the midsole body 110 is formed with a loading recess 111. An outer periphery of the midsole body 110 is formed with a turned up portion 112. A rear foot part of the turned up portion 112 is formed at a lateral side portion and a rear surface portion thereof with first and second through holes (hollow portions) 114, 115.

Figure 11:
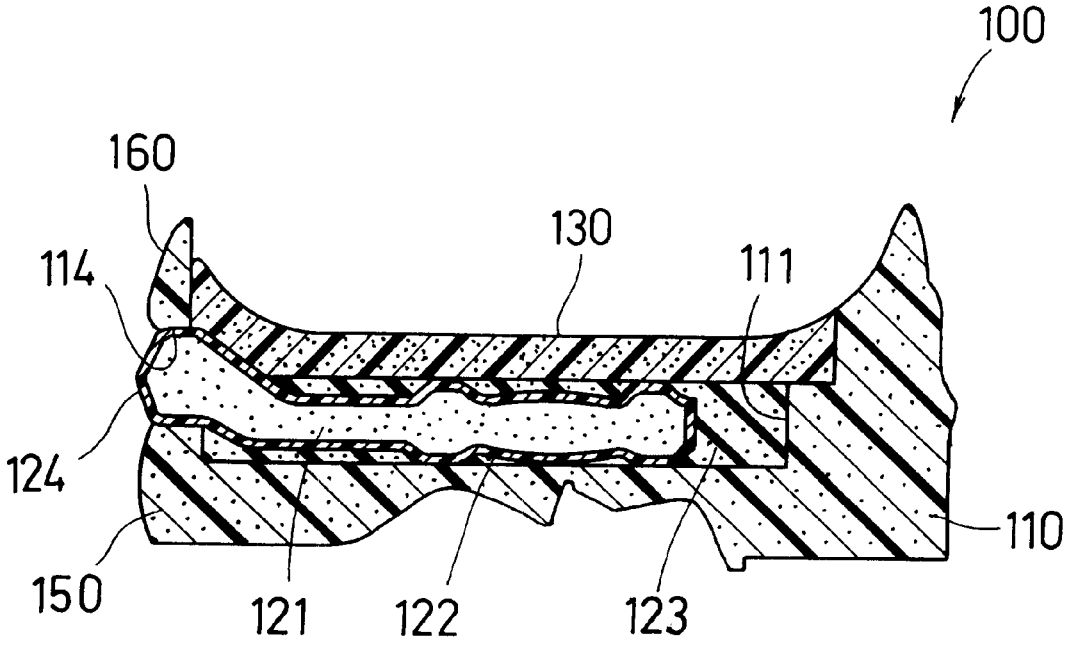
FIG. 11 is a sectional view taken along line XI—XI of FIG. 7(*a*).
Figure 12A:
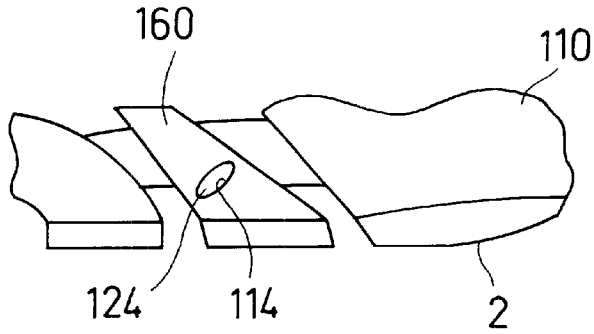
FIGS. 12(*a*) through 12(*d*) are diagrammatic views of the shoe sole including a shearing transformation element each of which is a variant of the second embodiment.
Figure 12B:
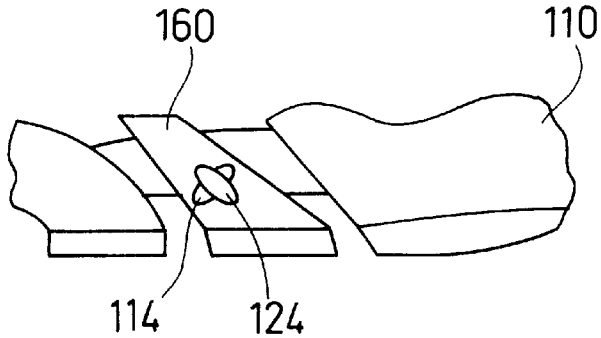
Figure 12C:
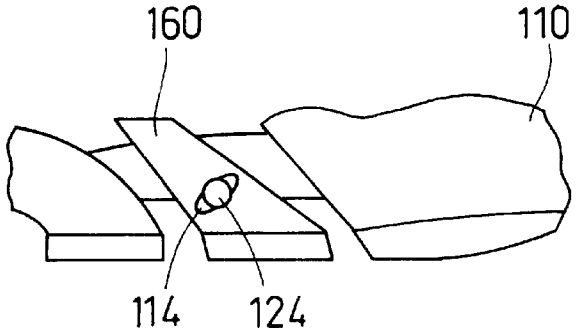
Figure 12D:
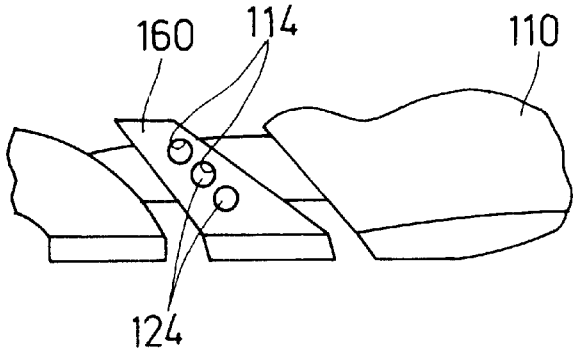

Referring to FIGS. 10 and 11, the mount part 120 comprises a gel 121 having a property of a fluid, a sealed vessel 122 formed from a soft resin and filled with the gel 121, and a foam 123 of polyurethane. The foam 123 is formed integrally with the sealed vessel 122. The gel 121 and the sealed vessel 122 constitute a soft shock absorbing element having loaded portions 124, 125, which protrude from the foam 123.

Figure 9:
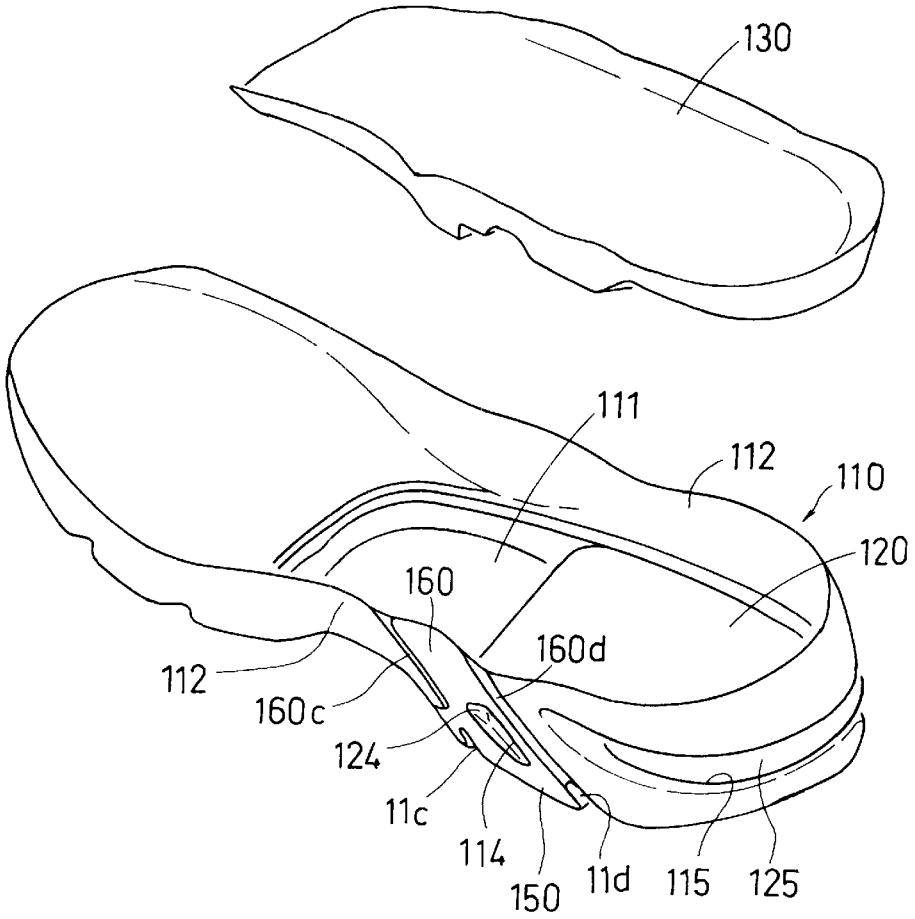
FIG. 9 is an exploded perspective view of the midsole of aforedescribed Figures wherein the midsole is disassembled.

As shown in FIG. 9, when the mount part 120 is loaded in the loading recess 111, the loaded portions 124, 125, respectively, are fitted into the first and second through holes 114, 115. In this state, the loaded portions 124, 125 are exposed outward from the first and second through holes 114, 115.

In FIG. 8, a lower shearing transformation element 150 and a lateral shearing transformation element 160 are formed integrally on a lateral side of the rear foot part of the midsole body 110. As shown in FIG. 7(*b*), the lower shearing transformation element 150 has, like the first shearing transformation element 11 shown in FIG. 1, a front end surface 11*c* and a rear end surface 11*d*, and has a longitudinal cross section that is generally a parallelogram in shape.

The lateral shearing transformation element 160 comprises a front end portion 160*c* and a rear end portion 160*d*, and is shaped to be in the form of a substantially parallelogram. The midsole body 110 and the cap 30 except the lower shearing transformation element 150 and the lateral shearing transformation element 160 constitute a compression transformation element. The compression transformation element performs a compression transformation when subjected to load from above.

The front end portion 160*c* and the rear end portion 160*d* of the lateral shearing transformation element 160 are defined by grooves formed by scraping surfaces of the midsole body 110. Also, a front end portion and a rear end portion of the lower shearing transformation element 150 are defined by slits 150*c*, 150*d*.

The lateral shearing transformation element 160 is formed with the first through hole 114. The loaded portion 124 is loaded in the first through hole 114 of the lateral shearing transformation element 160. Accordingly when the lateral shearing transformation element 160 is subjected to load from above, the lateral shearing transformation element 160 is liable to perform a shearing transformation.

Referring, for example, to FIGS. 10, the first through hole 114 and the loaded portion 124 are inclined in a direction along the front end portion 160*c* and the rear end portion 160*d* of the lateral shearing transformation element 160. In the present invention, however, the direction, in which the first through hole 114 and the loaded portion 124 are inclined, can be selected among various directions, as shown for example in FIGS. 12(*a*) to 12(*d*). Also, the loaded portion 124 may not be inclined. Also, the first through hole 114 and the loaded portion 124 are substantially triangular-shaped in the embodiment shown in FIG. 7, but may be elliptic, circular or the like other than triangular. Also, a plurality of loaded portions 124 may be provided as shown in FIG. 12(*d*).

Figure 13B:
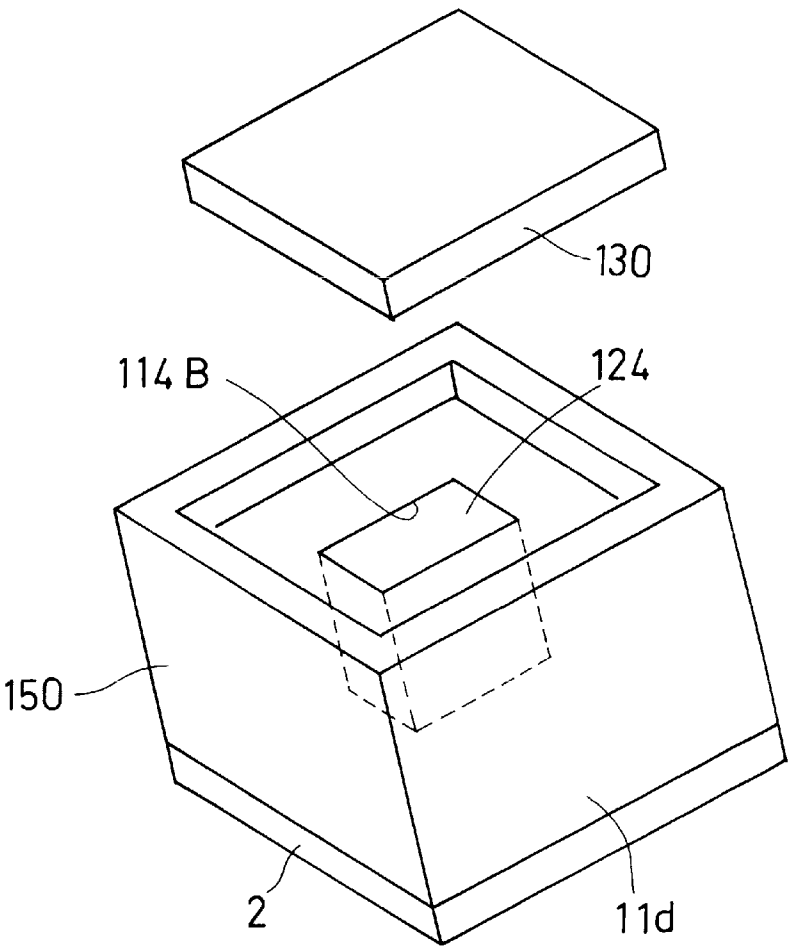
FIGS. 13(*a*) and 13(*b*) are perspective views of the shearing transformation element each of which is a variant of the second embodiment.
Figure 13A:
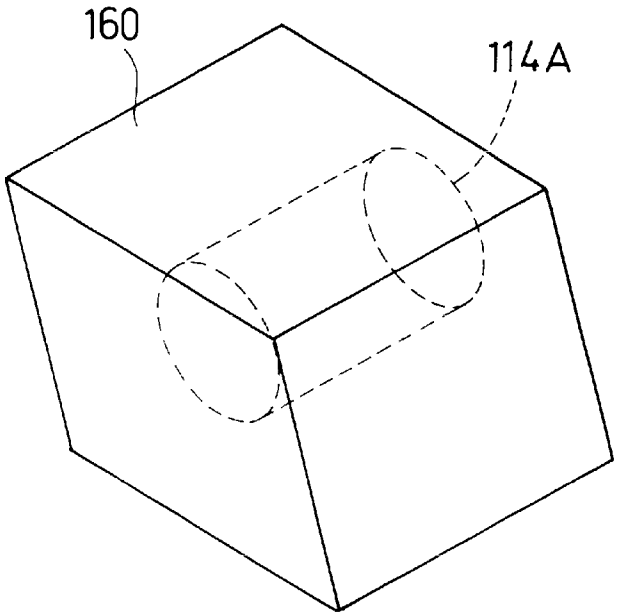

Referring to FIG. 13, the hollow portion may assume, in place of the first through hole 114, a configuration not opened toward the outer peripheral surface, that is, a recess 114A as shown in FIG. 13(*a*). Further, the hollow portion may be formed, as shown in FIG. 13(*b*), by an upwardly opened recess 114B in place of the first through hole 114. In the case where the hollow portion is not a through hole as in FIGS. 13(*a*) and 13(*b*), a soft shock absorbing element, which is composed of a gel not filled in the sealed vessel 122, may be filled in the recess 114A, 114B.

Specific Third Embodiment

Figure 14B:
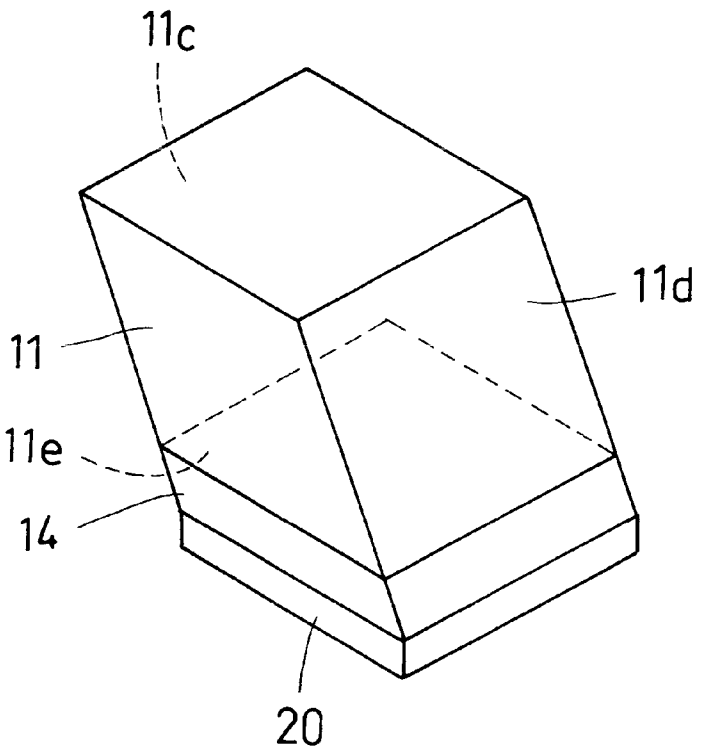
FIGS. 14(*a*) and 14(*b*) are perspective views of the shearing transformation element in accordance with a third specific embodiment of the present invention, respectively.
Figure 14A:
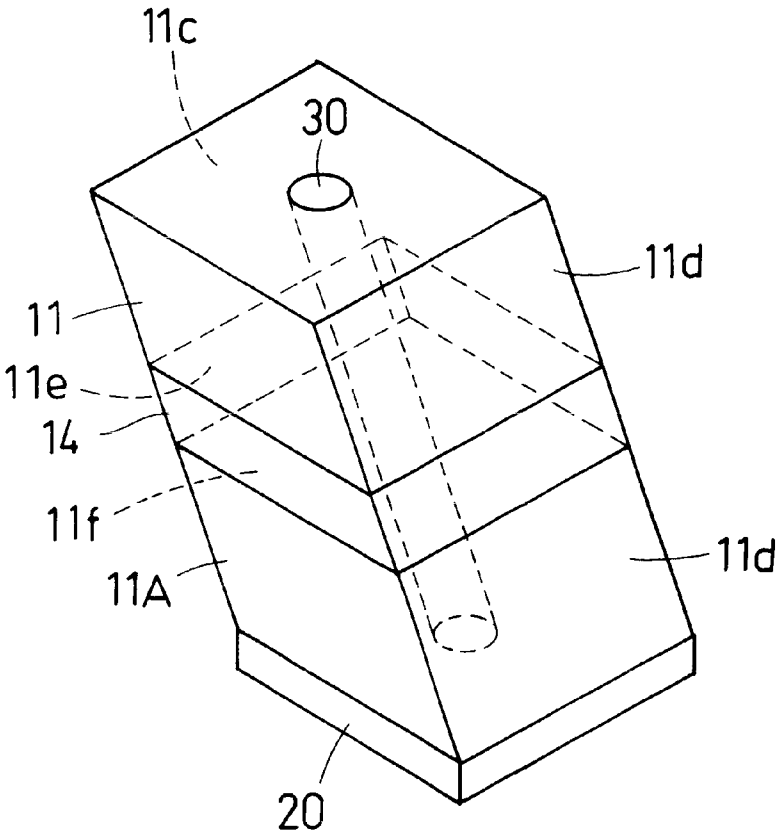
Figure 15:
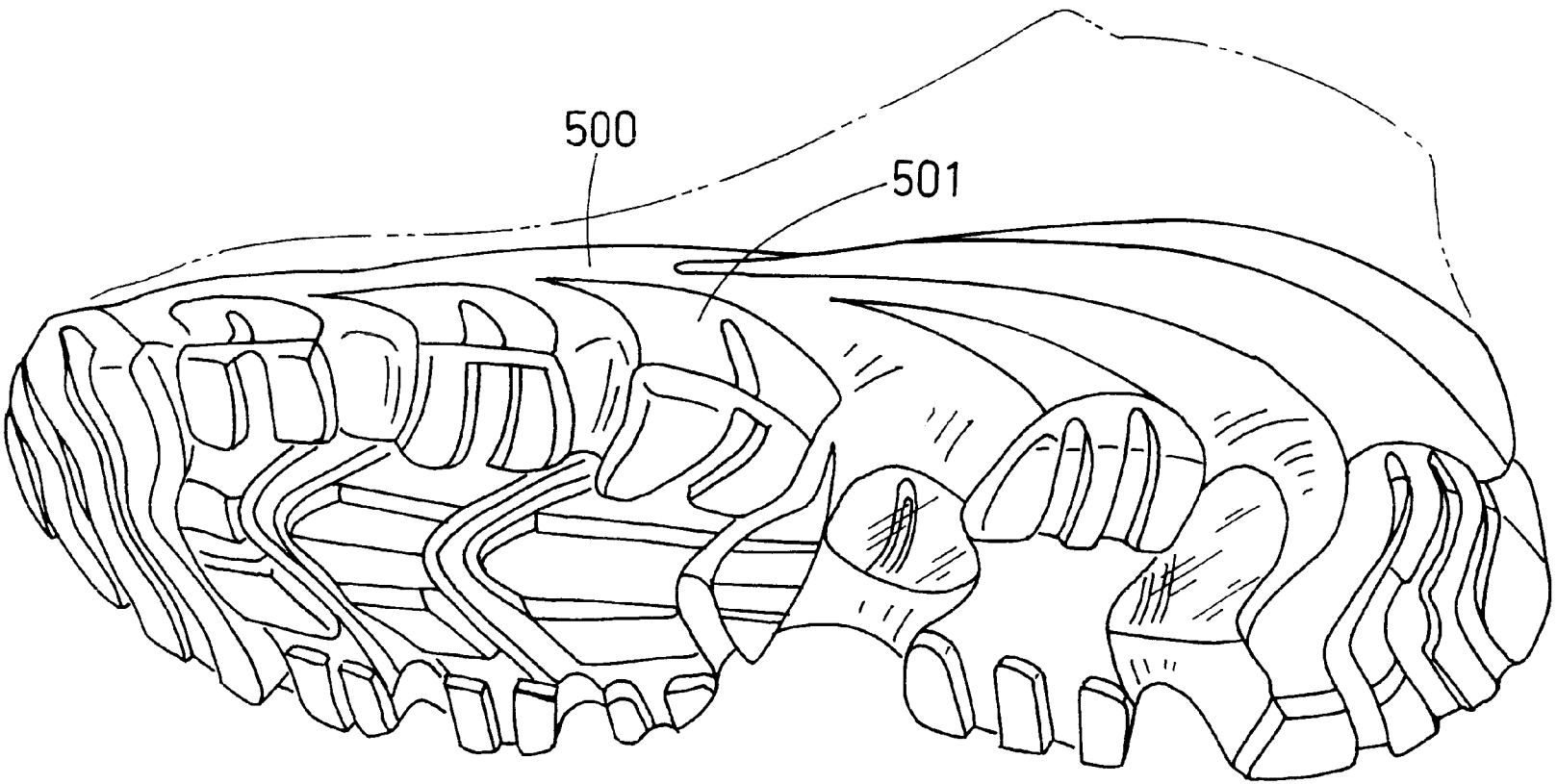
FIG.15 PRIOR ART
FIG. 15 is a perspective view of a shoe sole disclosed in U.S. Pat. No. 5,718,063.

FIG. 14(*a*) shows a specific third embodiment.

In this figure, a pair of upper and lower shearing transformation elements 11, 11A constitutes a part of a midsole. A soft shock absorbing element 14 is interposed between a lower end surface 11*e* of the upper shearing transformation element 11 and an upper end surface 11*f* of the lower shearing transformation element 11A. The soft shock absorbing element 14 contacts with the two end surface 11*e*, 11*f*.

A fixed rod 30 extends through the shearing transformation elements 11, 11A and the soft shock absorbing element 14. The fixed rod 30 serves to prevent the soft shock absorbing element 14 from being displaced horizontally. In addition, the fixed rod 30 is formed from a vertically compressible elastomer. The provision of the fixed rod 30 enables formation of the soft shock absorbing element 14 from a gel. However, in the case where the gel is filled in the sealed vessel to form the soft shock absorbing element 14, there is no need of provision of the fixed rod 30. Also, when a recess being loaded with the soft shock absorbing element 14 is formed on a portion of the midsole, there is no need of provision of the fixed rod 30.

Other specific constructions for the inclined columnar configuration are shown in the cross section view of FIG. 5. With such constructions, because the shearing transformation is performed by not only the shearing transformation element 11, 11A but also the soft shock absorbing element, the shearing transformation element 11, 11A becomes to perform the shearing transformation easily. Accordingly, the shock absorption is improved.

In particular, when the soft shock absorbing element 14 is constructed by setting, as shown in FIG. 14(*a*), to have the shape of parallelogram in longitudinal cross section so as to perform shearing transformation, the soft shock absorbing element 14 will also exhibit a greater shock absorbing property.

In addition, the soft shock absorbing element 14 may be interposed between the lower end surface 11*e* of the upper shearing transformation element 11 and an outer sole 20.

Although the invention has been described hereinbefore in connection with its preferred embodiments with reference to the accompanying drawings, those skilled in the art could easily imagine various modifications and corrections within the scope of apparent range in view of the description thus far made.

For example, the shearing transformation elements may be formed of a foam made from a resin other than the EVA. On the other hand, the invention need not always be provided with the other soft shock absorbing elements 14.

Therefore, such modifications and corrections should be interpreted to fall within the scope of the invention, as defined by the following claims.

What is claimed is:

1. A shock absorber structure of a shoe sole with a shock absorbing section provided on the shoe sole, wherein said shock absorbing section is provided with a plurality of shearing transformation elements which are supported at an upper position dislocated forward with respect to a grounding surface so that each of them performs a shearing transformation independently in such a manner as to fall forward due to a load applied from above, wherein axes formed of loci of centers of plane sections of said shearing transformation elements are inclined forward as they go upward, respectively, and wherein between said plurality of shearing transformation elements, there are provided soft shock absorbing elements which have a smaller Young's modulus than that of said shearing transformation elements so that said individual shearing transformation elements can perform shearing transformations without any restriction from each other.

2. A shock absorber structure as defined in claim 1, wherein said shoe sole is provided with: a support member jointed to an upper adapted to cover an instep and receiving a load from a foot; a midsole forming said shock absorbing section; and an outer sole formed on a lower face of said midsole, and wherein said shearing transformation elements are fixed on a bottom face of said support member.

3. A shock absorber structure of a shoe sole with a midsole interposed between an upper adapted to cover an instep and an outer sole having a treading face on its outer surface, wherein said midsole has a shearing transformation element, wherein said shearing transformation element has a front end face and a rear end face, and wherein the front end face and the rear end face of said shearing transformation element are individually inclined forward as they go upward, whereby with these inclinations of said two end faces, said shearing transformation element performs a shearing transformation due to a load at a grounding time of a walking or running user's foot, wherein each of the front end face and the rear end face of said shearing transformation element is provided in proximity with a soft shock absorbing element which is set to have such a smaller Young's modulus than that of said shearing transformation element as to allow the shearing transformation of said shearing transformation element.

4. A shock absorber structure as defined in claim 3, wherein said shearing transformation element has a longitudinal section, as taken in the longitudinal direction, formed into a generally parallelogram shape.

5. A shock absorber structure as defined in claim 3, wherein said shearing transformation element is disposed at a rear foot part in said midsole.

6. A shock absorber structure as defined in claim 5, wherein said shearing transformation element is disposed at a lateral side of the foot in said midsole.

7. A shock absorber structure as defined in claim 5, wherein said shearing transformation element is molded independently of a portion other than said shearing transformation element of said midsole.

8. A shock absorber structure as defined in claim 5, wherein said midsole has a thin connecting portion connecting said shearing transformation element and a portion other than said shearing transformation element of said midsole, and wherein said shearing transformation element is integrally molded through said thin connecting portion.

9. A shock absorber structure of a shoe sole with a midsole interposed between an upper adapted to cover an instep and an outer sole having a treading face on its outer surface, wherein said midsole has a shearing transformation element, wherein said shearing transformation element has a front end face and a rear end face, and wherein the front end face and the rear end face of said shearing transformation element are individually inclined forward as they go upward, whereby with these inclinations of said two end faces, said shearing transformation element performs a shearing transformation due to a load at a grounding time of a walking or running user's foot, wherein at least one of said two end faces of said shearing transformation element is provided in proximity with a soft shock absorbing element which is set to have such a smaller Young's modulus than that of said shearing transformation element as to allow the shearing transformation of said shearing transformation element.

10. A shock absorber structure of a shoe sole with a midsole interposed between an upper adapted to cover an instep and an outer sole having a treading face on its outer surface, wherein said midsole comprises: a compression transformation element performing a compression transformation due to a load applied from above; a shearing transformation element performing a shearing transformation in such a manner as to fall forward due to said load applied from above; and a soft shock absorbing element, wherein said shearing transformation element has a hollow portion for said soft shock absorbing element being loaded into, wherein said soft shock absorbing element is loaded into said hollow portion, and wherein said soft shock absorbing element is set to have such a smaller Young's modulus than that of said shearing transformation element as to allow the shearing transformation of said shearing transformation element.

11. A shock absorber structure as defined in claim 10, wherein said hollow portion has an open portion in an outer circumferential face of said midsole, and wherein said soft shock absorbing element is exposed from said open portion toward an outside of said midsole.

12. A shock absorber structure as defined in claim 11, wherein said shearing transformation element has a front end portion and a rear end portion, wherein said front end portion is defined by a slit and/or a groove which are/is formed in said midsole, and wherein said rear end portion is defined by said slit and/or said groove which are/is formed in said midsole.

13. A shock absorber structure as defined in claim 12, wherein said soft shock absorbing element comprises a gel filled into a resinous sealed vessel.

14. A shock absorber structure as defined in claim 12, wherein the front end portion and the rear end portion of said shearing transformation element are individually inclined forward as they go upward, whereby with these inclinations of said two end portions, said shearing transformation element has a longitudinal section, as taken in the longitudinal direction, formed into a generally parallelogram shape, and said shearing transformation element performs a shearing transformation due to a load at a grounding time of a walking or running user's foot.

15. A shock absorber structure as defined in claim 14, wherein said shearing transformation element is essentially disposed at a lateral side of a rear foot part in said midsole and is scarcely disposed or not disposed at all at a front foot part and a medial side of said rear foot part in said midsole.

16. A shock absorber structure of a shoe sole with a midsole interposed between an upper adapted to cover an instep and an outer sole having a treading face on its outer surface, wherein said midsole comprises:

a compression transformation element performing a compression transformation due to a load applied from above; and a shearing transformation element having very little the continuity of transformation relationship to said compression transformation element, wherein said shearing transformation element has a front end face and a rear end face, and wherein each of the front end face and the rear end face of said shearing transformation element defines a slit extending along a direction of a width of a foot in a bottom portion of the shoe sole, wherein the slit disconnects said shearing transformation element from said compression transformation element, wherein the front end face and the rear end face of said shearing transformation element are individually inclined forward as they go upward, whereby with these inclinations of said two end faces, said shearing transformation element has a longitudinal section, as taken in the longitudinal direction, formed into a generally parallelogram shape, and said shearing transformation element performs a shearing transformation due to a load at a grounding time of a walking or running user's foot.

17. A shock absorber structure of a shoe sole with a midsole interposed between an upper adapted to cover an instep and an outer sole having a treading face on its outer surface, wherein said midsole comprises:

a compression transformation element performing a compression transformation due to a load applied from above; and a shearing transformation element having very little the continuity of transformation relationship to said compression transformation element, wherein said shearing transformation element has a front end face and a rear end face, and wherein each of the front end face and the rear end face of said shearing transformation element defines a slit extending along a direction of a width of a foot in a bottom portion of the shoe sole, wherein the slit disconnects said shearing transformation element from said compression transformation element, wherein the front end face and the rear end face of said shearing transformation element are individually inclined forward as they go upward, whereby with these inclinations of said two end faces, said shearing transformation element performs a shearing transformation due to a load at a grounding time of a walking or running user's foot, wherein said compression transformation element performs said compression transformation to absorb shock, and wherein said shearing transformation element is essentially disposed at a lateral side of a rear foot part in said midsole and is scarcely disposed or not disposed at all at a front foot part and a medial side of said rear foot part in said midsole.

18. A shock absorber structure as defined in claim 17, wherein said compression transformation element is disposed at said front foot part and said medial side of said rear foot part in said midsole.

19. A shock absorber structure as defined in claim 18, wherein said shearing transformation element has a longitudinal section, as taken in the longitudinal direction, formed into a generally parallelogram shape.

20. A shock absorber structure of a shoe sole with a midsole interposed between an upper adapted to cover an instep and an outer sole having a treading face on its outer surface, wherein said midsole comprises:

a compression transformation element disposed at said front foot part and said medial side of said rear foot part in said midsole, performing a compression transformation due to a load applied from above, and a shearing transformation element having very little the continuity of transformation relationship to said compression transformation element, wherein said shearing transformation element has a front end face and a rear end face, wherein said shearing transformation element has a longitudinal section, as taken in the longitudinal direction, formed into a generally parallelogram shape, and wherein the front end face and the rear end face of said shearing transformation element are individually inclined forward as they go upward, whereby with these inclinations of said two end aces, said shearing transformation element performs a shearing transformation due to a load at a grounding time of a walking or running user's foot, wherein said compression transformation element performs said compression transformation to absorb shock, and wherein said shearing transformation element is essentially disposed at a lateral side of a rear foot part in said midsole and is scarcely disposed or not disposed at all at a front foot part and a medial side of said rear foot part in said midsole, wherein at least one of said two end faces of said shearing transformation element is provided in proximity with a soft shock absorbing element which is set to have such a smaller Young's modulus than that of said shearing transformation element as to allow the shearing transformation of said shearing transformation element.

21. A shock absorber structure of a shoe sole with a midsole interposed between an upper adapted to cover an instep and an outer sole having a treading face on its outer surface, wherein said midsole has a shearing transformation element, said shearing transformation element performs a shearing transformation due to a load at a grounding time of a walking or running user's foot, wherein either an upper end face or a lower end face of said shearing transformation element is provided in proximity with a soft shock absorbing element which is set to have a smaller Young's modulus than that of said shearing transformation element.

22. A shock absorber structure as defined in claim 21, wherein said soft shock absorbing element performs a compression transformation and said shearing transformation due to said load at said grounding time of said walking or running user's foot.

* * * * *